United States Patent [19]

Osmalov

[11] Patent Number: 4,522,214

[45] Date of Patent: Jun. 11, 1985

[54] METHOD AND APPARATUS FOR CONTROLLING A CIGARETTE MAKER TO PRODUCE A CIGARETTE ROD WITH PREDETERMINED MOISTURE CONTENT

[75] Inventor: Jerome S. Osmalov, Richmond, Va.

[73] Assignee: Philip Morris Incorporated, New York, N.Y.

[21] Appl. No.: 343,021

[22] Filed: Jan. 27, 1982

Related U.S. Application Data

[63] Continuation of Ser. No. 111,521, Jan. 14, 1980, abandoned.

[51] Int. Cl.[3] ..... A24C 5/14; A24C 5/39

[52] U.S. Cl. ..... 131/79; 131/108; 131/909; 131/84.1

[58] Field of Search ..... 131/280, 303, 905, 906, 131/907, 908, 909, 910, 108, 31, 62, 79, 84 R

[56] References Cited

U.S. PATENT DOCUMENTS 3,159,746 12/1964 Powell et al. .
3,386,448 6/1968 Wochnowski ..... 131/303
3,411,513 11/1968 Knobel .
3,595,067 7/1971 Von Der Lohe et al. .
3,648,035 3/1972 Hart et al. .
3,738,376 6/1973 Labbe et al. .
3,742,795 7/1973 Lipcon et al. .
3,905,123 9/1975 Fowler et al. .
3,999,134 12/1976 Lorenzen .
4,030,511 6/1977 Wahle .
4,315,515 2/1982 Mills .

FOREIGN PATENT DOCUMENTS 0953792 4/1964 United Kingdom ..... 131/62
1376747 12/1974 United Kingdom .

*Primary Examiner*—Vincent Millin

[57] ABSTRACT

A method and apparatus are disclosed for controlling the operation of a cigarette maker to produce a cigarette rod having a predetermined moisture content. The moisture of the rod leaving the maker is sensed and the tobacco being input to the maker is treated as a function of the measured moisture content, in such a manner as to cause the output rod to have the desired moisture content. Preferably, other characteristics of the output rod, such as density and firmness, are also monitored, and are taken into account in controlling the treatment of the tobacco stream being input into the maker.

31 Claims, 1 Drawing Figure

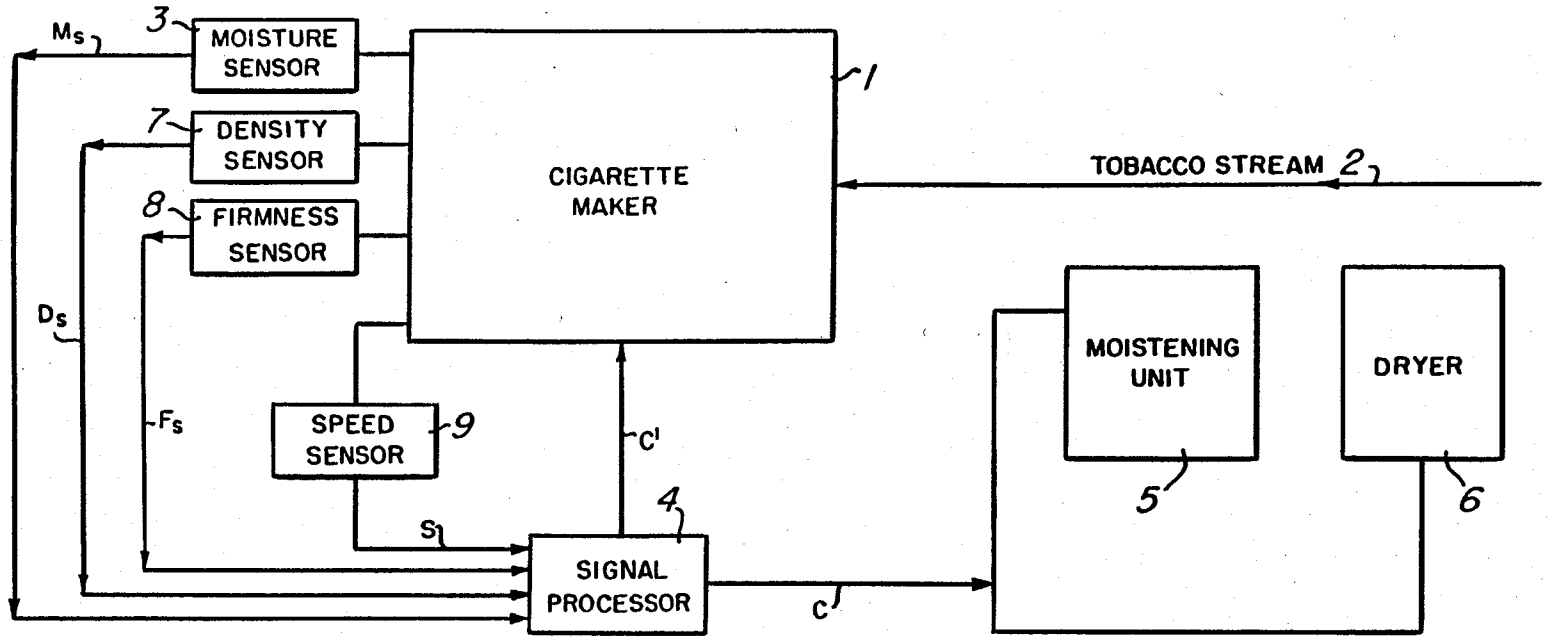
TOBACCO STREAM
2
DRYER
6
MOISTENING UNIT
5
1
CIGARETTE MAKER
C'
4
SIGNAL PROCESSOR
C
9
SPEED SENSOR
S
MOISTURE SENSOR
3
DENSITY SENSOR
7
FIRMNESS SENSOR
8
Fs
Ms
Ds

METHOD AND APPARATUS FOR CONTROLLING A CIGARETTE MAKER TO PRODUCE A CIGARETTE ROD WITH PREDETERMINED MOISTURE CONTENT

RELATED APPLICATION

This application is a continuation of U.S. application Ser. No. 111,521, filed Jan. 14, 1980, assigned in common with the present application, and now abandoned.

BACKGROUND OF THE INVENTION

This invention pertains to cigarette manufacture and, in particular, to control of cigarette manufacture at the cigarette maker.

In cigarette manufacture, it is customary to condition the tobacco during the primary processing thereof. As part of this conditioning, the tobacco is subjected to procedures wherein the tobacco moisture content is measured, and the measured moisture content is used to control drying or moistening apparatus to achieve a predetermined moisture content. Procedures of this type are disclosed in U.S. Pat. Nos. 3,840,025, 3,482,162, and 3,502,085.

After primary processing, the tobacco is usually stored for a period of time, which may be up to three days, before being made into cigarettes by a cigarette maker. In conventional practice, the storage areas are subjected to a controlled climate in order to maintain the tobacco moisture content at the predetermined level established during the primary processing. Despite such costly storage procedures, the tobacco may still undergo moisture changes while being transported to the cigarette maker. These moisture changes adversely affect maker operation, particularly in cases where the maker is provided with controls for establishing preselected values for various cigarette rod parameters such as rod density and rod firmness. This is mentioned in British Specification No. 1,376,747, which discloses a microwave system for controlling tobacco rod density. In this system, since the microwave energy is affected by moisture as well as by tobacco content, the system is constructed to permit obtaining values of each of these parameters from microwave signals which depend on both.

SUMMARY OF THE INVENTION

It is an object of the present invention to provide more effective moisture control in the manufacture of cigarettes.

It is a further object of the present invention to provide a method and apparatus for improved cigarette maker operation.

In accordance with the principles of the present invention, a cigarette maker is provided with means for determining the moisture content of the cigarette rod produced by the maker and wherein means is provided for controlling, the moisture content of the tobacco input to the maker, as a function of the determined moisture content.

In the illustrative embodiments of the invention disclosed hereinafter, determined cigarette rod moisture content is utilized to control the moisture content of the input tobacco as it is being conveyed to the maker. Control is effected by determining the difference between the output cigarette rod moisture content and a desired moisture content and using this difference to control the addition of moisture to the input tobacco or subtraction of moisture from it until output rod moisture content is at at the target value.

The invention further contemplates use of several techniques for determining rod moisture content. These techniques require sensors for generating sensor signals related to output rod parameters such as moisture, firmness, density and speed.

Also contemplated is use of the moisture control system with a firmness control system to provide a rod of a preselected firmness at a preselected moisture.

BRIEF DESCRIPTION OF THE FIGURES

The above and other features and aspects of the present invention will become more apparent from the following detailed description taken in conjunction with the accompanying FIGURE which shows a system for controlling cigarette rod moisture content at a cigarette maker in accordance with the principles of the present invention.

DETAILED DESCRIPTION OF THE PREFERRED EMBODIMENTS

The FIGURE shows a system in accordance with the principles of the present invention for providing moisture control at a cigarette maker 1. The maker 1 can be of a conventional type, such as those manufactured by Molins Ltd. of the United Kingdom under model numbers MK8 and MK9.

In typical operation, the maker 1 provides from the input tobacco stream 2 a continuous cigarette rod which is cut into lengths to make individual cigarettes. In accordance with the present invention, cigarette maker operation is controlled to give the cigarette rod a moisture content substantially equal to a desired or target moisture value $M_t$. In this manner, individual cigarettes resulting from the rod have a substantially equal, precisely determined moisture content, improving the uniformity, and thus the quality of the product.

A moisture sensor 3 at the cigarette maker 1 monitors the cigarette rod and generates an output electrical signal $M_s$ indicative of rod moisture content. The moisture sensor signal $M_s$ is fed to a signal processor 4 which generates an output control signal C for controlling the moisture content of the rod. In accordance with the invention, such control is effected by changing the moisture content of the input tobacco 2 until the output rod moisture content equals the target value. This may be accomplished by utilizing the signal C to appropriately control conventional moistening means or dryer means, or both, beside the conveyance path of the input tobacco.

In the illustrative case shown in the FIGURE, a moistening unit 5, which might comprise, for example, a steam source followed by a controllable valve, and a dryer 6 respectively add moisture to and subtract it from the input tobacco 2 responsive to the signal C. With this form of control, the control signal C brings the moistening unit 5 into operation during periods when the output rod moisture content is below target moisture and brings the dryer 6 into operation during periods when the output rod moisture content is above the target value.

Alternatively, and still in accordance with the invention, either the moistening unit 5 or the dryer 6 is used, but not both. If the moistening unit 5 is used, the tobacco 2 is precessed during primary processing and storage so that its moisture content is always below the target value $M_t$ upon entry to the moistening unit 5, so that moisture must always be added thereto to obtain a moisture content of $M_t$ for the output rod. If the dryer 6 is used, on the other hand, the tobacco 2 is processed during primary processing such that its moisture content is always above the target value $M_t$ upon entry to the dryer 6, thereby always requiring the subtraction of moisture to obtain a moisture content of $M_t$ for the output rod.

The processing operations of the signal processor 4 involve generating a rod moisture content signal $M_c$ from the moisture sensor signal $M_s$ and forming the control signal C from comparison of the generated signal $M_c$ with the target moisture $M_{tl}$. *Generation of the signal $M_c$* by the processor 4 is carried out by processing the signal $M_s$ to provide a signal which is representative of the actual rod moisture content, and depends to a large degree on the particular moisture sensor 3 being used. Where the characteristics of the moisture sensor 3 are such that the sensor signal $M_s$ is itself representative of true rod moisture content, $M_c$ is equal to $M_s$. On the other hand, where the sensor characteristics result in an $M_s$ signal varying from true rod moisture content, $M_s$ is adjusted to take the sensor characteristics into account. In actual practice, the necessary adjustment can be empirically determined for each particular moisture sensor.

As is discussed below, additional sensors 7 and 8 for measuring the mass (density) and the firmness of the cigarette rod can also be employed for enabling moisture sensor signal adjustment. In addition, a speed or velocity sensor 9 can be provided for cigarette rod speed determination and included for sensor signal adjustment.

A resistance type moisture sensor might be used. Such a sensor might be formed on the above-mentioned conventional maker by inserting probes through apertures along the length of the so-called tongue of the maker, the probes being of sufficient length to enter the tobacco rod. A current or voltage could then be supplied to the probe and the resultant voltage or current through the probe circuit measured to determine the tobacco rod resistance, and, therefore, the rod moisture content. In particular, such probes could serve as inputs to the internal circuitry of a model No. TM-80 sensor manufactured by Testron to provide the moisture measurement.

Utilizing such a resistance moisture sensor provides a moisture sensor signal $M_s$ requiring adjustment for arriving at the actual rod moisture content $M_c$. In particular it has been found that the sensor moisture signal $M_s$ requires adjustment as a function of rod firmness and rod speed. Thus, for this sensor, moisture content can be expressed as follows:

$$M_c = A_0 + A_1 M_s + A_2 F_s + A_3 S \quad (1)$$

where $A_0$–$A_3$ are constants which can be empirically determined for each particular tobacco blend and resistance sensor. With the resistance type sensor, the signal processor 4 utilizes the sensor signal $M_s$, the firmness sensor signal $F_s$ and the speed sensor signal S to derive the moisture content signal $M_c$ from equation (1).

Other techniques for monitoring rod moisture content utilize microwave components. One microwave technique depends upon the measurement of the power absorbed by the cigarette rod (largely by the moisture in the rod) as it moves through a suitable microwave cavity. With this type of moisture sensor, the moisture sensor signal $M_s$ is a function of reflected and transmitted microwave power in the absence and presence of the cigarette rod, these values being suitably adjusted for temperature variations in the cavity, the rod or both. Hence, $M_s$ is as follows:

$$M_s = \frac{(R_a + T_a) - (R_p + T_p)}{(R_a + T_a)} \cdot 100 \quad (2)$$

where $R_a$ and $T_a$ are temperature-adjusted values of the reflectance and transmittance of microwave power in the absence of the cigarette rod and $R_p$ and $T_p$ are temperature-adjusted values of the reflectance and transmittance in the presence of the cigarette rod. In this case, the sensor signal $M_s$ requires adjustment related to the mass of the cigarette rod, and the moisture content is given as:

$$M_c = B_0 + B_1 M_s / D_s \quad (3)$$

In this situation the constants $B_0$ and $B_1$ can also be empirically determined for the particular tobacco blend and microwave sensor being used.

As noted above, the signal processor 4 determines the control signal C based upon the sensor signal $M_s$ adjusted by certain of the other sensor signals $F_s$, $D_s$ and S according to equations (1), (2) and (3). The processor 4 might typically take the form of a general or special purpose digital computer programmed in accordance with these equations and having stored therein the target values and appropriate constants. A typical microcomputer might be an Intel System 80/204 provided with an Intel System SBC 116 board. Interfacing such microcomputer with the analog signals $M_s$, $F_s$, $D_s$, S and C might typically be a model MP 8418-PGA-AO Burr-Brown A/D-D/A converter.

The firmness sensor 8 utilized with the present invention can be of a strain gauge type and may, for example, be of the type shown and described in U.S. Pat. No. 4,033,360. Additionally, the density sensor 7 might be a beta gauge type manufactured by Molins Ltd. and supplied with its model number MK8 or MK9 cigarette maker. The speed sensor 9, on the other hand, might be a tachometer of conventional design yielding a value of voltage to represent revolutions per minute.

The present invention can be utilized with other controls at the maker to enhance or promote maker efficiency. Thus, for example, the signal processor may be utilized to generate in addition a firmness control signal C′ designed to control the maker such that the output rod has a predetermined firmness $F_t$ at the target moisture $M_t$. Since the moisture control of the system maintains the output rod moisture content substantially at target moisture $M_t$, the firmness variations requiring correction will depend almost solely on tobacco content variations.

A system for controlling firmness in this manner is disclosed in commonly assigned U.S. patent application Ser. No. 111,607 filed 4/27/82 now U.S. Pat. No. 4,326,542. In the system of the latter patent application, the control signal C′ is expressed as follows:

$$C' = (F_s - F_{sm}) - F_t \quad (4)$$

where $F_{sm}$ is firmness content in the tobacco attributable to moisture referenced to target moisture and is given as $$F_{sm}=K_1(M_c-M_t) \quad (5)$$

The latter expression, in turn, is derivable from rod firmness attributable to moisture which can be expressed as:

$$F_m=K_0+K_1M_c \quad (6)$$

where $K_0$ is a constant determined by the tobacco blend and the rod weight per unit volume and $K_1$ is a negative constant determined by the tobacco blend only.

In a system of this type firmness control can be achieved by utilizing the control signal C′ to adjust the height of the ecreteur blade used to cut the tobacco stream at a given depth during rod formation. Alternatively, the control signal C′ might be used to control the maker distributor to obtain the desired control. Such practices are disclosed, for example, in U.S. Pat. No. 3,595,067.

Although the present invention has been described in connection with several currently preferred embodiments thereof, many variations and alternative embodiments will now be apparent to those skilled in the art. Accordingly, the scope of the present invention is not to be limited by the details described herein, but only by the appended claims.

What is claimed is:

1. Apparatus for making a cigarette rod, said apparatus comprising:

a cigarette maker for making a cigarette rod;

control means for controlling the moisture content of tobacco being input to said cigarette maker, in a manner effective to cause the cigarette rod to have a predetermined moisture content; and sensor means for generating a moisture sensor signal representative of the moisture content of the cigarette rod; said control means being for controlling the moisture content of the input tobacco responsive to said moisture sensor signal.

2. Apparatus for controlling the operation of a cigarette maker, said apparatus comprising:

first sensor means for providing a moisture sensor signal related to the moisture content of a cigarette rod being produced by a cigarette maker with which said apparatus is being used;

signal processor means including a microprocessor for processing said moisture sensor signals for generating a moisture content signal corresponding to the actual moisture in the cigarette rod; and moisture control means responsive to said moisture signal for adjusting the moisture content of the tobacco being input to such maker.

3. Apparatus for controlling the operation of a cigarette maker, said apparatus comprising:

first sensor means for providing a moisture sensor signal related to the moisture content of a cigarette rod being produced by a cigarette maker with which said apparatus is being used;

a second sensor means for providing a firmness sensor signal related to the firmness of such cigarette rod; and means responsive to said moisture sensor signal for controlling the moisture content of tobacco being input into such maker.

4. Apparatus in accordance with claim 3, further comprising means responsive to said firmness sensor signal for controlling the firmness of the cigarette rod.

5. Apparatus in accordance with claim 4, wherein said moisture control means is for maintaining the moisture content of the input tobacco at a level to cause the cigarette rod to have a predetermined moisture content; and wherein said firmness control means is for maintaining the firmness of the cigarette rod at a predetermined firmness at said predetermined moisture content.

6. Apparatus in accordance with claim 3, further comprising a third sensor means for providing a speed sensor signal related to the speed of the cigarette rod.

7. Apparatus in accordance with claim 6, wherein said first sensor means is a resistance type moisture sensor.

8. Apparatus in accordance with claim 3, further comprising a further sensor means for providing a density sensor signal related to the density of the cigarette rod.

9. Apparatus in accordance with claim 8, wherein said first sensor means is a microwave type moisture sensor.

10. Apparatus in accordance with claim 3, 6, 7, 8 or 9, wherein said control means includes:

a signal processor responsive to said sensor signals for generating a moisture content signal corresponding to the actual moisture in the cigarette rod; and moisture control means responsive to said moisture content signal for adjusting the moisture content of the input tobacco.

11. Apparatus in accordance with claim 10, wherein said control means includes a signal processor responsive to said sensor signals for generating a control signal dependent upon a comparison of said moisture content signal and said predetermined moisture content, and wherein said moisture control means is responsive to said control signal and includes means for adding moisture to the input tobacco responsive to said control signal, whereby the input tobacco can be made during primary processing to have, consistently, a moisture content below what is necessary to give the cigarette rod said predetermined moisture content.

12. Apparatus in accordance with claim 10, wherein said signal processor generates a control signal dependent upon a comparison of said moisture content signal and said predetermined moisture content, and wherein said moisture control means is responsive to said control signal and includes means for subtracting moisture from the input tobacco responsive to said control signal, whereby the input tobacco can be made during primary processing to have, consistently, a moisture content above what is necessary to give the cigarette rod said predetermined moisture content.

13. A method for controlling the operation of a cigarette maker to which tobacco is input to produce a cigarette rod, said method comprising:

sensing the moisture content of the cigarette rod leaving said maker to provide a moisture sensor signal; and controlling the moisture content of the tobacco being input to said maker, as a function of said moisture sensor signal.

14. A method for controlling the operation of a cigarette maker to which tobacco is input to produce a cigarette rod, said method comprising the steps of:

sensing the moisture content of the cigarette rod to provide a moisture sensor signal;

sensing the firmness of the cigarette rod to provide a firmness sensor signal; and controlling the moisture content of the input tobacco as a function of said moisture sensor signal.

15. A method in accordance with claim 14, further comprising controlling the firmness of the cigarette rod based on said firmness sensor signal.

16. A method in accordance with claim 14, wherein said step of controlling the moisture content of the input tobacco is carried out by maintaining said moisture content of the input tobacco at a level which causes the moisture content of the cigarette rod to be at a predetermined moisture content; and wherein the step of controlling the firmness of the cigarette rod is carried out by maintaining said firmness at a predetermined value at said predetermined moisture content.

17. A method in accordance with claim 14, further comprising sensing the density of the cigarette rod to provide a density sensor signal; and wherein said step of controlling said moisture content of the input tobacco is based on said moisture and density sensor signals.

18. A method in accordance with claim 14, wherein said step of controlling the moisture content of the cigarette rod is based on said moisture, firmness and speed sensor signals.

19. A method in accordance with claim 14, 16, 17 or 18, wherein said step of controlling the moisture content of the input tobacco comprises processing said sensor signals to generate a moisture content signal corresponding to the actual moisture in the cigarette rod;

and adjusting the moisture content of the input tobacco based on said moisture content signal.

20. A method in accordance with claim 19, wherein the input tobacco has a moisture content below a predetermined moisture content desired in the cigarette rod and wherein said step of processing said sensor signals includes comparing said moisture content signal and said predetermined moisture content; and wherein said step of adjusting said moisture content of the input tobacco is carried out by adding moisture to the input tobacco based on said comparison of said moisture content signal and said predetermined moisture content.

21. A method in accordance with claim 19, wherein the input tobacco has a moisture content above a predetermined moisture content desired in said rod and wherein said step of processing said sensor signals includes comparing said moisture content signal and said predetermined moisture content; and wherein said step of adjusting said moisture content of the input tobacco is carried out by subtracting moisture from the input tobacco based on said comparison of said moisture content signal and said predetermined moisture content.

22. Apparatus in accordance with claim 1, further comprising a second sensor means for providing a firmness sensor signal related to the firmness of the cigarette rod.

23. Apparatus in accordance with claim 22, further comprising means responsive to said firmness sensor signal for controlling the firmness of the cigarette rod.

24. Apparatus in accordance with claim 23, wherein said firmness control means is for maintaining the firmness of the cigarette rod at a predetermined firmness at said predetermined moisture content.

25. Apparatus in accordance with claim 22, further comprising a third sensor means for providing a speed sensor signal related to the speed of the cigarette rod.

26. Apparatus in accordance with claim 25, wherein said first sensor means is a resistance type moisture sensor.

27. Apparatus in accordance with claim 22, further comprising a further sensor means for providing a density sensor signal related to the density of the cigarette rod.

28. Apparatus in accordance with claim 27, wherein said first sensor means is a microwave type moisture sensor.

29. Apparatus in accordance with claim 2, wherein said control means includes:

a signal processor responsive to said sensor signals for generating a moisture content signal corresponding to the actual moisture in the cigarette rod; and moisture control means responsive to said moisture content signal for adjusting the moisture content of the input tobacco.

30. Apparatus in accordance with claim 29, wherein said signal processor is for generating a control signal dependent upon a comparison of said moisture content signal and said predetermined moisture content, and wherein said moisture control means is responsive to said control signal and includes means for adding moisture to the input tobacco responsive to said control signal, whereby the input tobacco can be made during primary processing to have, consistently, a moisture content below what is necessary to give the cigarette rod said predetermined moisture content.

31. Apparatus in accordance with claim 29, wherein said signal processor generates a control signal dependent upon a comparison of said moisture content signal and said predetermined moisture content, and wherein said moisture control means is responsive to said control signal and includes means for subtracting moisture from the input tobacco responsive to said control signal, whereby the input tobacco can be made during primary processing to have, consistently, a moisture content above what is necessary to give the cigarette rod said predetermined moisture content.

* * * * *

UNITED STATES PATENT AND TRADEMARK OFFICE

CERTIFICATE OF CORRECTION

PATENT NO. : 4,522,214

DATED : June 11, 1985

INVENTOR(S) : Jerome S. Osmalov

It is certified that error appears in the above-identified patent and that said Letters Patent is hereby corrected as shown below:

Column 2, line 67, "precessed" should be --processed--.

Column 3, line 14, "$M_{tl}$. Generation of the" should be --$M_t$. Generation of the--;

line 15, "signal $M_c$ by" should be --signal $M_c$ by--.

Claim 29, line 1, "2," should be --1,--.

Signed and Sealed this

Seventh Day of April, 1987

*Attest:*

DONALD J. QUIGG

*Attesting Officer*

*Commissioner of Patents and Trademarks*